US010687617B2

(12) United States Patent
Davis et al.

(10) Patent No.: US 10,687,617 B2
(45) Date of Patent: Jun. 23, 2020

(54) MODULAR SHELF SYSTEM WITH TAB AND SLOT MOUNTING

(71) Applicant: Clark Davis, Provo, UT (US)

(72) Inventors: Clark Evan Davis, Provo, UT (US); Paul Schmidt, Provo, UT (US)

( * ) Notice: Subject to any disclaimer, the term of this patent is extended or adjusted under 35 U.S.C. 154(b) by 0 days.

(21) Appl. No.: 16/567,399

(22) Filed: Sep. 11, 2019

(65) Prior Publication Data

US 2020/0000222 A1 Jan. 2, 2020

Related U.S. Application Data

(63) Continuation-in-part of application No. 16/051,213, filed on Jul. 31, 2018, now Pat. No. 10,415,612.

(60) Provisional application No. 62/539,654, filed on Aug. 1, 2017.

(51) Int. Cl.
*A47B 57/42* (2006.01)
*A47B 57/40* (2006.01)

(52) U.S. Cl.
CPC ..... *A47B 57/425* (2013.01); *A47B 57/404* (2013.01)

(58) Field of Classification Search
CPC ..... A47B 57/425; A47B 57/20; A47B 57/42; A47B 57/404; A47B 96/061
See application file for complete search history.

(56) References Cited

U.S. PATENT DOCUMENTS

| | | | |
|---|---|---|---|
| 919,257 | A | 4/1909 | Seydewitz |
| 981,532 | A | 1/1911 | Cary |
| 1,061,297 | A | 5/1913 | Johnson |
| 1,419,647 | A | 6/1922 | Shepherdson |
| 1,747,900 | A | 2/1930 | Jenny |
| 1,903,631 | A | 4/1933 | Morrison |
| 1,940,117 | A | 12/1933 | Carpos |
| 2,240,256 | A | 4/1941 | Elmendorf |
| 2,279,864 | A | 4/1942 | Eide |
| 2,334,912 | A | 11/1943 | Eide |
| 2,369,930 | A | 2/1945 | Wagner |
| D144,730 | S | 5/1946 | Perrault |

(Continued)

FOREIGN PATENT DOCUMENTS

| | | | | |
|---|---|---|---|---|
| DE | 1529719 | A1 * | 5/1969 | ..... A47B 96/061 |
| DE | 3925302 | A1 * | 2/1991 | ..... A47B 57/425 |

(Continued)

OTHER PUBLICATIONS

Celery Rocking Chair viewed at http://www.eroomservice.com/manufacturer/celery/ circa Dec. 3, 2011.

(Continued)

*Primary Examiner* — Daniel J Rohrhoff

(74) *Attorney, Agent, or Firm* — Pate Peterson PLLC; Brett Peterson

(57) ABSTRACT

A modular shelving system includes a wall panel with slots and shelf brackets with tabs which attach to the wall panel slots. The tabs have upwardly sloping surfaces which engage sloped surfaces on the back side of the slots. These mating surfaces better retain the tabs into the slots and provide a higher degree of strength in the tab and slot joint. This allows the shelving system to be made with smaller tabs and thinner material than previously possible; providing a more secure and visually appealing shelving system.

19 Claims, 5 Drawing Sheets

(56) References Cited

U.S. PATENT DOCUMENTS 2,418,731 A 4/1947 Seitz
2,479,086 A 8/1949 Silverman
2,481,671 A 9/1949 John et al.
2,486,987 A 11/1949 Scarlett
2,518,955 A 8/1950 Stelzer
2,534,413 A 12/1950 Cenis
2,551,071 A 5/1951 Tyncs
D164,552 S 9/1951 Curtis
2,595,002 A 4/1952 Schneider
2,602,012 A 7/1952 Doty
2,615,771 A 10/1952 Curtis
2,632,498 A 3/1953 Curtis
2,672,181 A 3/1954 Rose
2,677,491 A 5/1954 Burger
2,720,253 A 10/1955 Turner
2,745,591 A 5/1956 Holt
2,786,789 A 3/1957 Carlson
2,792,877 A 5/1957 West
2,825,101 A 3/1958 Rubsnstein
3,053,598 A 9/1962 Cheslow
3,089,675 A * 5/1963 Lozier ..... A47B 57/425
248/242
3,149,880 A 9/1964 Steuer
3,186,027 A 6/1965 Merillat
3,262,405 A 7/1966 Sutton
3,300,170 A * 1/1967 Raffa ..... A47B 57/42
248/242
3,300,245 A 1/1967 Rumble
D212,601 S 11/1968 Rubsnstein
3,527,497 A 9/1970 Self
3,547,491 A 12/1970 Bovasso
3,578,385 A 5/1971 Stiglitz
3,603,274 A * 9/1971 Ferdinand ..... A47B 57/425
108/108
3,603,656 A 9/1971 Ferman
3,697,363 A 10/1972 Martinez
3,788,700 A 1/1974 Wartes
3,812,977 A 5/1974 Glassman
3,847,435 A 11/1974 Skinner
4,055,924 A 11/1977 Beaver
D247,596 S 3/1978 Osamu
4,082,356 A 4/1978 Johnson
4,103,818 A 8/1978 Raubenheimer
4,140,065 A 2/1979 Chacon
4,153,311 A 5/1979 Takhasaki
4,158,277 A 6/1979 Krempp et al.
4,188,067 A 2/1980 Elmer
4,191,113 A 3/1980 Hogberg
4,202,581 A 5/1980 Fleishman
4,225,180 A 9/1980 Gillis
4,258,464 A 3/1981 Ullman
4,348,052 A 9/1982 Roland
4,390,204 A 6/1983 Fleishman
4,419,028 A 12/1983 Roland
4,433,753 A 2/1984 Watson
4,433,843 A 2/1984 Bricco
4,492,332 A 1/1985 Collins
4,509,794 A 4/1985 Roland
4,533,174 A 8/1985 Fleishman
4,544,092 A 10/1985 Palmer
4,548,350 A 10/1985 Engle
4,574,917 A 3/1986 Stoddard
4,591,090 A 5/1986 Collins
4,593,950 A 6/1986 Vittorio
4,595,105 A 6/1986 Gold
D289,234 S 4/1987 Hoult
4,685,609 A 8/1987 Ferrari
4,712,837 A 12/1987 Swilley
4,759,449 A 7/1988 Gold
D299,087 S 12/1988 Bruce
4,841,878 A 6/1989 Kriegsman
D302,216 S 7/1989 Roland
4,846,530 A 7/1989 Noble
4,867,327 A 9/1989 Roland
4,878,439 A 11/1989 Samson
4,926,759 A 5/1990 Vitsky et al.
5,011,228 A 4/1991 Marcantel
5,069,144 A 12/1991 Williford
5,082,329 A 1/1992 Mars
5,253,595 A 10/1993 Heidmann
5,263,766 A 11/1993 McCullough
5,275,467 A 1/1994 Kawecki
5,354,589 A 10/1994 Waas
5,367,964 A 11/1994 Hockensmith
5,387,027 A 2/1995 Maloney
5,454,331 A 10/1995 Green
5,605,378 A 2/1997 Oyediran
5,613,449 A * 3/1997 Pullman ..... A47B 57/425
108/102
5,644,995 A 7/1997 Gurwell et al.
5,655,812 A 8/1997 Albecker
5,765,922 A 6/1998 Hsia
5,803,548 A 9/1998 Battle
5,921,631 A 7/1999 Bush
5,927,816 A 7/1999 Hsu
5,941,377 A 8/1999 Hart
5,992,938 A 11/1999 Jones
6,036,270 A 3/2000 Bufalini
6,041,920 A 3/2000 Hart
D422,799 S 4/2000 Dworshak et al.
6,053,585 A 4/2000 Osen
6,109,695 A 8/2000 Kahwaji
6,126,022 A 10/2000 Merkel
6,155,641 A 12/2000 Frost
6,174,116 B1 1/2001 Brand
6,189,974 B1 2/2001 Beck
6,247,754 B1 6/2001 Vanderaue et al.
6,283,564 B1 9/2001 Corson
6,347,772 B1 2/2002 L'Hotel
6,378,707 B1 4/2002 Taggert
6,443,076 B1 9/2002 Case
6,532,878 B2 3/2003 Tidemann
6,595,378 B2 7/2003 Wang
D499,577 S 9/2003 Willy
6,615,746 B2 9/2003 Bart
6,615,999 B1 9/2003 Culp
6,619,749 B2 9/2003 Willy
6,675,979 B2 1/2004 Taylor
6,769,369 B1 8/2004 Brandenberg
6,807,912 B2 10/2004 Willy
6,845,871 B1 1/2005 Culp
6,848,747 B1 2/2005 Robinson
6,955,401 B1 10/2005 Shoulberg
7,066,548 B2 6/2006 Butler
7,114,300 B1 10/2006 Culp
7,168,766 B2 1/2007 Pelletier
7,219,962 B2 5/2007 Stone
D547,076 S 7/2007 Hughes et al.
7,255,403 B2 8/2007 Butler
7,300,110 B1 11/2007 Debien
7,533,940 B1 5/2009 Zook
7,631,605 B2 12/2009 Willy
7,856,772 B1 12/2010 Culp et al.
8,167,377 B2 5/2012 Kovach
8,220,399 B2 7/2012 Berent et al.
8,332,917 B2 12/2012 Forster et al.
8,528,979 B2 9/2013 College
8,590,976 B2 11/2013 Davis
8,667,911 B2 3/2014 Brandenberg
9,277,814 B2 * 3/2016 Winker ..... A47B 87/005
9,534,623 B2 1/2017 Anderson et al.
9,615,663 B2 4/2017 Davis
1,022,716 A1 3/2019 Davis
1,041,561 A1 9/2019 Davis
2003/0107255 A1 6/2003 Willy
2004/0056526 A1 3/2004 Willy
2004/0227041 A1 * 11/2004 Lewis ..... A47B 57/425
248/220.41
2008/0074013 A1 3/2008 Ahlgrim et al.
2009/0066140 A1 3/2009 Berent et al.
2010/0003077 A1 1/2010 Kelley
2012/0080910 A1 4/2012 Davis
2013/0062294 A1 3/2013 Beaty
2013/0080286 A1 3/2013 Rotholz

(56) References Cited

U.S. PATENT DOCUMENTS

| | | | | |
|---|---|---|---|---|
| 2013/0170904 | A1 | 7/2013 | Cappelle | |
| 2014/0263130 | A1 | 9/2014 | Davis | |
| 2015/0335155 | A1* | 11/2015 | Winker | A47B 87/005 211/90.02 |
| 2017/0023043 | A1 | 1/2017 | Koelling et al. | |
| 2017/0079426 | A1 | 3/2017 | Davis | |
| 2017/0086578 | A1* | 3/2017 | Nowak | A47B 57/425 |
| 2017/0099961 | A1* | 4/2017 | Church | A47F 5/0043 |
| 2018/0112696 | A1 | 4/2018 | Davis | |
| 2019/0038023 | A1* | 2/2019 | Stocker | A47B 96/061 |
| 2019/0040890 | A1 | 2/2019 | Davis | |
| 2019/0059593 | A1 | 2/2019 | Davis | |
| 2019/0059594 | A1 | 2/2019 | Davis | |
| 2019/0085886 | A1 | 3/2019 | Davis | |
| 2019/0107131 | A1 | 4/2019 | Davis | |

FOREIGN PATENT DOCUMENTS

| | | |
|---|---|---|
| DE | 102007058662 | 6/2009 |
| GB | 2353080 | 2/2001 |
| NL | 1025719 | 9/2005 |
| WO | WO 2005-085656 | 9/2005 |

OTHER PUBLICATIONS

PlyGrid Shelves viewed at http://offi.com/products/offikids/PLYGRID.php?p2c=249 circa Dec. 3, 2011.

Snap Table viewed at http://www.offi.com/pdfs/snaptable.pdf circa Dec. 3, 2011.

Furniture viewed at http://www.playatech.com/product_list.php circa Dec. 3, 2011.

Arabic Table viewed at http://www.plydea.com/support/assemblypdf.html circa Dec. 3, 2011.

Blue7Chair viewed at http://www.plydea.com/support/assemblypdf.html circa Dec. 3, 2011.

First Desk viewed at http://www.plydea.com/support/assemblypdf.html circa Dec. 3, 2011.

Rinaldo Chair viewed at http://www.plydea.com/support/assemblypdf.html circa Dec. 3, 2011.

Tuffet Stool viewed at http://www.plydea.com/support/assemblypdf.html circa Dec. 3, 2011.

WasteNot Basket viewed at http://www.plydea.com/support/assemblypdf.html circa Dec. 3, 2011.

Winehold Wine Rack viewed at http://www.plydea.com/support/assemblypdf.html circa Dec. 3, 2011.

* cited by examiner

MODULAR SHELF SYSTEM WITH TAB AND SLOT MOUNTING

PRIORITY

The present application claims the benefit of U.S. patent application Ser. No. 16/051,213, filed Jul. 31, 2019, which is herein incorporated by reference in its entirety, and which claims the benefit of U.S. Provisional Application Ser. No. 62/539,654, filed Aug. 1, 2017, which is herein incorporated by reference in its entirety.

THE FIELD OF THE INVENTION

The present invention relates to furniture and shelving. In particular, examples of the present invention relates to a tab and slot system which allows plywood to be used for a modular shelving system.

BACKGROUND

Many persons desire more natural home furnishings. These persons prefer furniture made from wood instead of plastic or metal. There is also increasing demand for modular furnishings which may be assembled as needed or which may be customized to meet the particular needs of the user.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
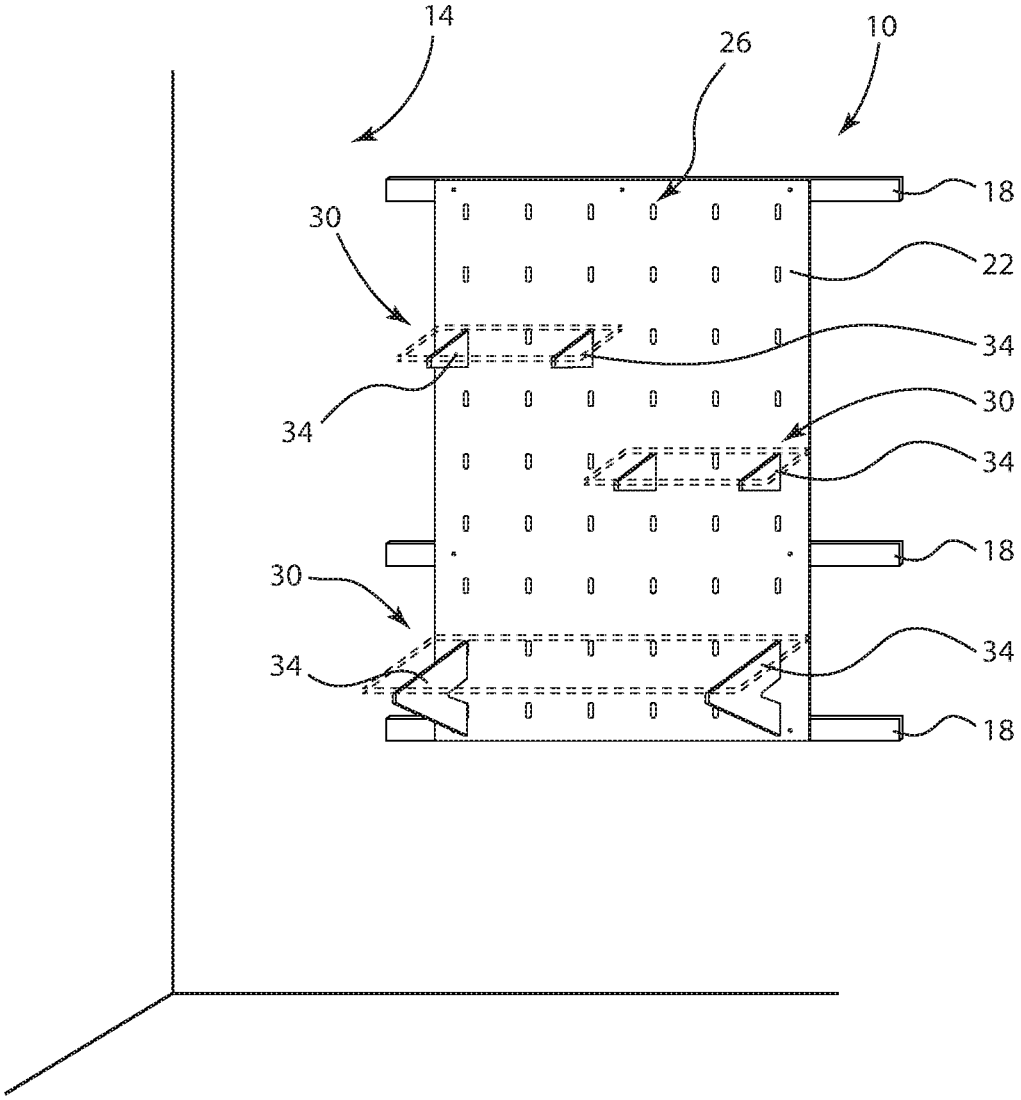
FIG. 1 is an isometric drawing of a modular shelving system.

Corresponding reference characters indicate corresponding components throughout the several views of the drawings. Unless otherwise noted, the drawings have been drawn to scale. Skilled artisans will appreciate that elements in the figures are illustrated for simplicity and clarity. For example, the dimensions of some of the elements in the figures may be exaggerated relative to other elements to help improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which are shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art.

As used herein, "adjacent" refers to near or close sufficient to achieve a desired effect. Although direct contact is common, adjacent can broadly allow for spaced apart features.

As used herein, the singular forms "a," and, "the" include plural referents unless the context clearly dictates otherwise.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a number or numerical range endpoint by providing that a given value may be "a little above" or "a little below" the number or endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Dimensions, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

The disclosure particularly describes a modular shelving unit with joints that provide sufficient strength and stability to allow cantilevered shelves to be made from plywood. The shelving unit includes a wall mounted panel with an array of slots formed in the panel. Cantilevered brackets attach to the wall mounted panel via tabs that engage the slots. The tabs and slots include an interface geometry which reduces the stress on the bracket and panel and allows the shelving unit to be made from materials such as plywood. The interface geometry also reduces the clearance which is required behind the wall mounted panel to accommodate the tabs. This allows the wall mounted panel to be mounted close to the wall and provides a more aesthetically pleasing shelving unit.

Turning now to FIG. 1, a drawing of a shelving unit is shown. The shelving unit 10 is mounted to a wall 14. The shelving unit includes mounting rails 18 which are mounted to the wall 14. A shelf mounting panel 22 is attached to the rails 18. The rails 18 space the mounting panel 22 away from the wall a small amount to accommodate the tabs on the shelf brackets. The rails 18 may be made from wood and may often be about 2 inches wide and between about ¼ inch thick and about 1 inch thick. The mounting rails 18 are also beneficial because they may be fastened to wall studs or may be mounted to the wall 14 with different types of concrete or sheetrock anchors as needed for strength. The shelf mounting panel 22 may then be mounted to the mounting rails 18 with more concern for appearance. The shelf mounting panel 22 may be supplied in different sizes as desired.

The shelf mounting panel 22 includes an array of slots 26. The shelf mounting panel 22 will typically include a number of different rows and columns of slots 26, allowing shelves to be mounted at different heights and positions. The slots are often placed in rows which are spaced apart approximately every 6 inches, allowing different shelf widths which are increments of the row spacing. The modular nature of the shelving allows a user to customize the shelving unit with different types of shelves placed in different locations as desired. FIG. 1 illustrates a number of example shelves 30. Each shelf 30 includes shelf mounting brackets 34. The shelf mounting brackets 34 include tabs that engage the slots 26 to attach the shelf mounting brackets 34 to the shelf mounting panel 22.

Figure 8:
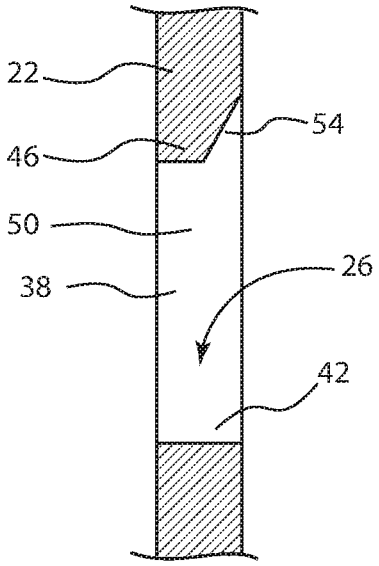
FIG. 8 is a cross sectional view of a slot in the wall mounting panel.
Figure 9:
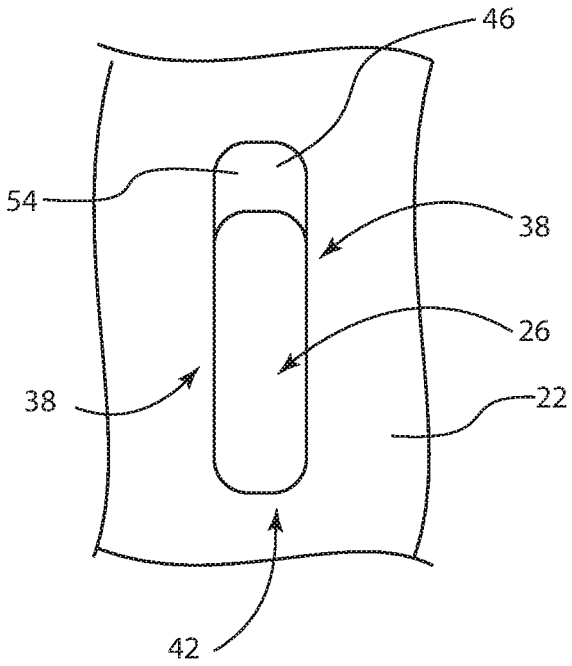
FIG. 9 is a drawing of a slot in the wall mounting panel.

FIGS. 2 through 5 show how a shelf mounting bracket 34 is attached to the shelf mounting panel 22. These figures also illustrate how the shelf mounting panel 22 is attached to the wall 14 via mounting rails 18. The mounting rails 18 space the shelf mounting panel 22 away from the wall 14 to provide space for the mounting bracket tabs as necessary. In the example shelving unit 10, the wall mounting panel 22 is about ⅜ inch thick. The shelf brackets 34 are about ½ inch thick. The slots 26 are about ½ inch wide and about 1 and ¼ inches high. The slots 26 extend through the wall mounting panel 22 and are open through the back of the wall panel 22. FIG. 8 shows a larger view of a slot 26 and FIG. 9 shows a drawing of a slot 26 from the back of the wall panel 22. Each slot 26 includes side walls 38, a bottom wall 42, and a top wall 46. The bottom wall 42 of the slots 26 is substantially square and perpendicular to the wall mounting panel 22, and may have rounded corners from cutting the slots 26 with a CNC router. The top wall 46 of the slots 26 is square when viewed from the front. The top wall 46 includes a straight section 50 extending in about half way from the front face of the wall panel 22 and an upwardly sloping section 54 extending inwardly from the straight section for about the last half of the thickness of the wall panel 22. The outer section 50 of the top wall 46 is generally perpendicular to the wall mounting panel 22. The upwardly sloping inner section 54 of the upper wall 46 is angled approximately 60 degrees upwardly from horizontal; about 30 degrees from vertical.

The shelf bracket 34 includes an inner end with tab 58 which extends outwardly and upwardly from the top of the inner end of the bracket 34. The tab 58 includes a sloped inner face 62 which extends upwardly from the bracket 34. The sloped inner face 62 extends upwardly and outwardly from the inner end of the bracket 34 at an angle of about 30 degrees from vertical. This angle matches the angle of the inner section 54 of the top wall 46 of the slot 26. The tab 58 includes a rounded outer edge which reduces the clearance necessary for inserting the tab 58 into the slot 26. The tab 58 includes a generally flat bottom edge 66 which rests against the bottom wall 42 of the slot 26. The outer section of the bottom edge 66 of the tab 58 includes a projection 70 which helps secure the tab 58 into the slot 26. The bottom of the inner end of the bracket 34 includes a generally flat surface 74 which rests against the wall mounting panel 22 when the bracket 34 is attached to the wall mounting panel 22.

Figure 2:
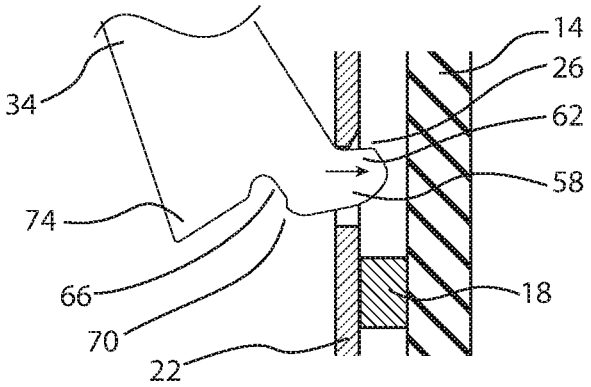
FIG. 2 is a drawing of a shelf bracket and the wall panel.
Figure 3:
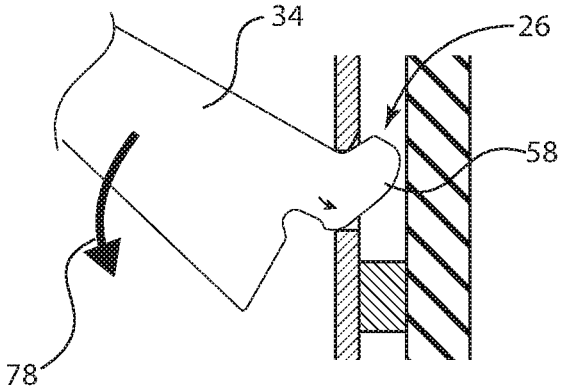
FIG. 3 is a drawing of a shelf bracket and the wall panel.
Figure 4:
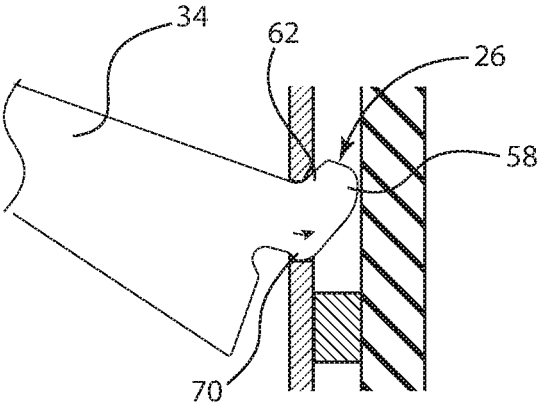
FIG. 4 is a drawing of a shelf bracket and the wall panel.
Figure 5:
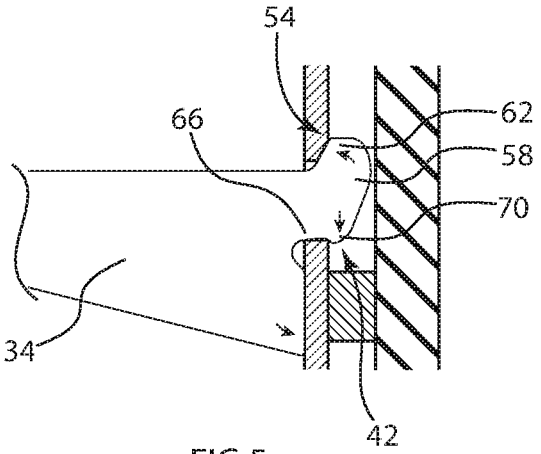
FIG. 5 is a drawing of a shelf bracket and the wall panel.

FIGS. 2 through 5 show how the tab 58 is inserted into the slot 26. For clarity in illustrating the insertion of the tab 58, not all structures are numbered in each drawing. As is shown in FIG. 2, the tab 58 is initially inserted into the slot 26 with the bracket 34 angles upwardly approximately 60 degrees. This places the sloped inner face 62 approximately parallel with the straight section 50 top wall 46 of the slot 26. The tab 58 can then be inserted into the slot 26 in a direction perpendicular to the wall mounting panel 22 to the position shown in FIG. 2. The bracket 34 is then rotated downwardly as indicated by arrow 78. This brings the bottom of the tab 58 into the slot 26. The bracket 34 is then moved further towards the wall mounting panel 22 as shown in FIG. 4. This moves the tab 58 deeper into the slot 26; moving the bottom projection 70 into the slot 26 and rotating the sloped inner edge 62 of the tab 58 towards the upper sloping section 54 of the top wall 46 of the slot 26. The bracket 34 is then rotated downwardly and simultaneously moved downwardly as shown in FIG. 5. This motion seats the flat bottom edge 66 of the tab 58 against the bottom wall 42 of the slot 26, the sloped inner edge 62 of the tab 58 against the sloped surface 54 of the slot 26, and nests the projection 70 around the bottom wall 42 of the slot 26 and the flat surface 74 of the bracket 34 against the face of the wall mounting panel 22. While this motion seems complicated written out in particular detail, it is accomplished in a fluid motion of inserting and rotating the bracket 34 relative to the wall panel 22. Once the bracket 34 is properly mounted to the wall panel 22, the bottom projection 70 engages the back side of the wall panel 22 (e.g. by engaging the back edge of the bottom wall of the slot) and keeps the bottom of the bracket from sliding outwardly away from the wall mounting panel 22 and secures the shelf 30 to the wall panel 22 unless the person lifts the bracket 34 and takes more purposeful action to remove the bracket 34 from the wall panel 22.

Figure 6:
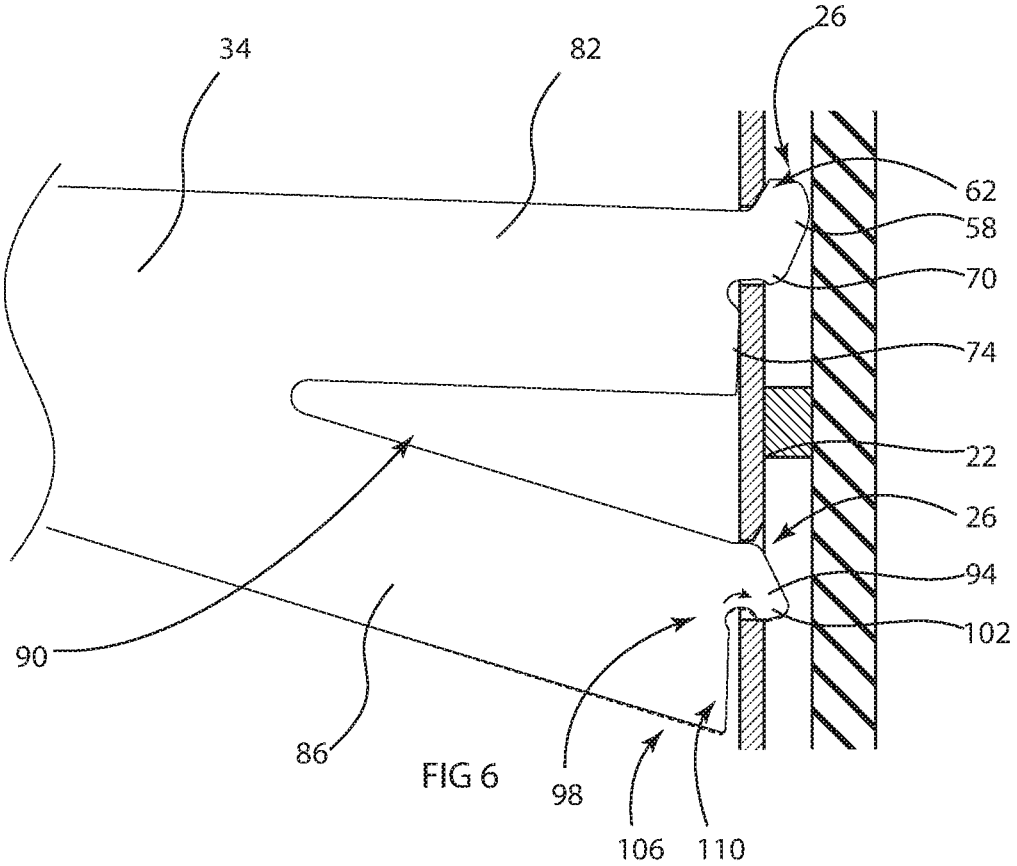
FIG. 6 is a drawing of a shelf bracket and the wall panel.
Figure 7:
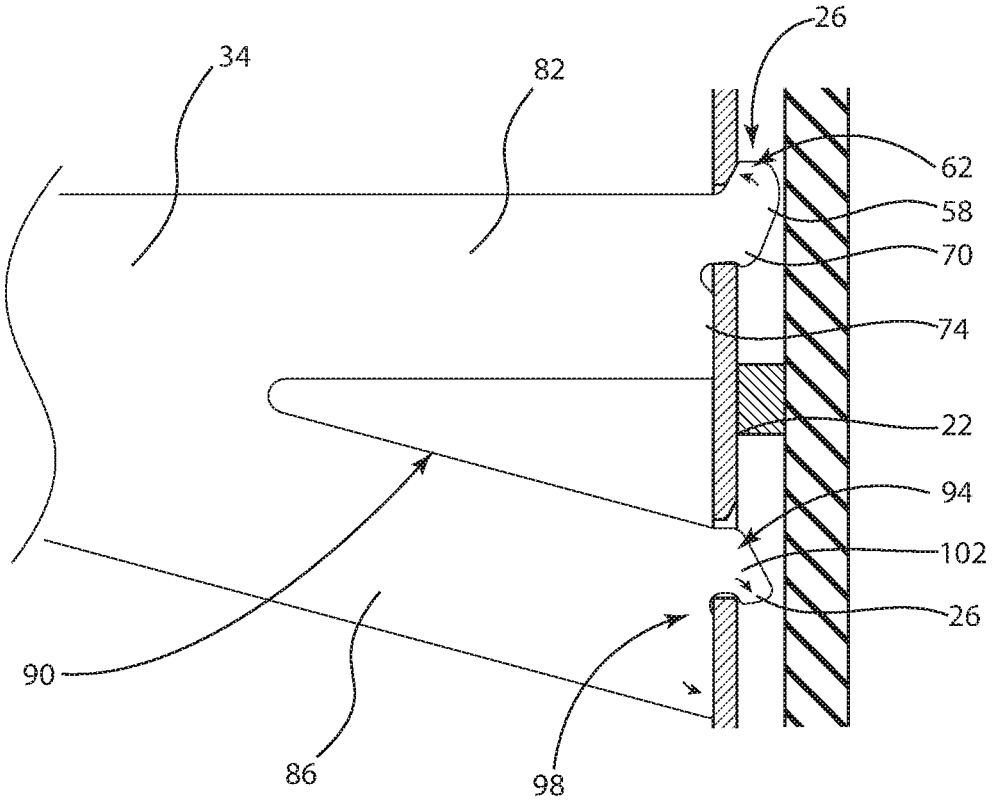
FIG. 7 is a drawing of a shelf bracket and the wall panel.

FIGS. 6 and 7 show another larger shelf bracket 34. The shelf bracket 34 is for larger shelves and will support more weight than the shelf bracket shown in FIGS. 2 through 5. The shelf bracket 34 includes an upper leg 82, a lower leg 86, and a cut out recess 90 between the upper leg 82 and the lower leg 86. The end of the upper leg 82 is the same as the end of the bracket 34 as described in FIGS. 2 through 5. The end of the upper leg 58 includes the tab 58 with the associated features described in FIGS. 2 through 5. The lower leg 86 includes a tab 94 which extends from the upper part of the end of the leg 86. The tab 94 extends outwardly and downwardly from the lower leg 86. The lower leg 86 and the tab 94 are positioned so that the tab 94 engages a slot 26 which is below the slot 26 engaged by the tab 58. The lower part of the tab 94 includes an inner recess 98 and an outer projection 102. The inner recess 98 is sufficiently wide to receive the lower wall 42 of the slot 26. The projection 102 extends downwardly beyond the lower wall 42 of the slot 26.

The bracket 34 is attached to the wall panel 22 by first attaching the upper leg 82 and tab 58 as described above with respect to FIGS. 2 through 5. During the last portion of the installation when the tab 58 is nearly seated into the slot 26, the lower leg 86 and tab 94 approach the wall panel 22. At this point in installation, the lower leg 86 is flexed upwardly as indicated at 106 so that the projection 102 will enter the slot 26. The bracket 34 is then rotated downwardly and moved towards the wall mounting panel 22 so that a lower flat surface 110 on the end of the lower leg 86 contacts the wall mounting panel 22. The projection 102 has then moved through the slot 26 and past the wall panel 22 and the lower leg 86 can be un-flexed to allow the inner recess 98 to engage the wall panel 22 and retain the lower leg 86 against the wall panel 22 as is shown in FIG. 7. If desired, the lower leg 86 may be flexed upwardly a small amount when in the assembled configuration shown in FIG. 7 to apply a degree of tension to the joint between the bracket 34 and the wall mounting panel 22. This tension holds the bracket 34 securely against the wall mounting panel 22 and prevents looseness in the joint. In an alternate example shelf bracket 34, the projection 102 may be on the top of the tab 94 with the inner recess 98 located between the projection 102 and the end of the lower leg 86.

Figure 10:
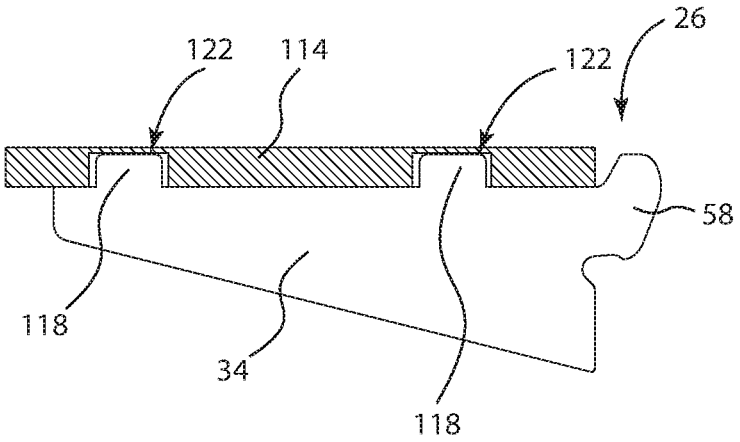
FIG. 10 is a drawing of an example shelf.

FIG. 10 shows a more detailed drawing of a shelf 26. The illustration applies equally to a larger or a smaller shelf bracket 34. For clarity, some structures such as the wall mounting panel 22 are omitted although they are present in the finished shelf. Additionally, not all structures are numbered for clarity in showing the shelf 26. The shelf 26 includes a bracket 34, and typically includes two or three brackets 34 depending on the size of the shelf 26. A horizontal shelf panel 114 is attached to the tops of the brackets 34. In order to secure the shelf panel 114, the brackets 34 may have tabs 118 which extend from the tops of the brackets 34 and engage slots 122 in the shelf panel 114. The tabs 118 and slots 122 may be simple tabs and slots or may be locking tabs and slots with tabs which engage the slots to prevent accidental removal of the tabs 118 from the slots 122.

Figure 11:
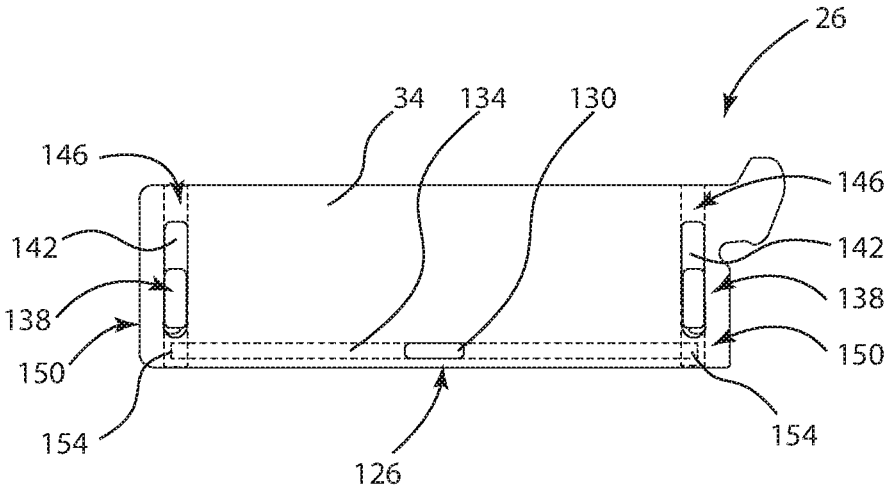
FIG. 11 is a drawing of an example shelf.

FIG. 11 shows another example shelf 26. This shelf 26 includes a storage receptacle or retaining wall to keep items on the shelf 26. The shelf 26 typically includes two brackets 34 which have deeper front ends to accommodate a storage receptacle. The brackets 34 include bottom slots 126 which receive tabs 130 on a horizontal support panel 134. The brackets 34 also include slots 138 which receive tabs 142 on front and back receptacle panels 146. The front and back receptacle panels 146 may include slots 150 which receive tabs 154 on the bottom support panel 134. The tabs 142 and slots 138 on the brackets 34 and front and back panels 146 employ a locking arrangement to keep the tabs 142 from pulling out of the slots 138.

The tabs 58 and slots 26 provide an interface geometry which provides a high degree of strength in wood products and particularly in plywood. This allows a shelving system including a wall panel 22 and shelf brackets 34 to provide a high degree of strength in a configuration which is not bulky. The shelf brackets 34 may often be about 3 inches tall and provide an attractive appearance. The shelf brackets 34 also engage the wall mounting panel 22 in a way which discourages accidental disassembly; making the shelf brackets more secure and stable. This makes the shelving system suitable for kid's rooms and craft rooms. The shelving system provides a natural and pleasing appearance and avoids a bulky appearance often present in modular furniture due to requiring overly thick materials to achieve sufficient joint strength.

The above description of illustrated examples of the present invention, including what is described in the Abstract, are not intended to be exhaustive or to be limitation to the precise forms disclosed. While specific examples of the invention are described herein for illustrative purposes, various equivalent modifications are possible without departing from the broader scope of the present claims. Indeed, it is appreciated that specific example dimensions, materials, values, etc., are provided for explanation purposes and that other values may also be employed in other examples in accordance with the teachings of the present invention.

What is claimed is:

1. A modular furniture system comprising:

a wall panel having a front surface and a back surface;

a first slot formed in the wall panel;

wherein the first slot has a top wall with an upwardly sloping section adjacent the back surface of the wall panel;

a shelf bracket attached to the wall panel via the first slot;

wherein the shelf bracket has a first end attached to the wall panel, the first end comprising a first tab which engages the slot;

wherein the first tab comprises an inwardly facing sloped surface on a top thereof, the inwardly facing sloped surface sloping upwardly away from the shelf bracket at an angle which is complementary to the upwardly sloping section of the first slot;

wherein the shelf bracket comprises a generally flat surface on the first end of the shelf bracket;

wherein the first tab is disposed in the first slot such that the inwardly facing sloped surface of the tab engages the upwardly sloping section of the first slot and such that the generally flat surface engages the front surface of the wall panel.

2. The modular furniture system of claim 1, wherein the upwardly sloping section of the first slot is disposed at an angle which is about 30 degrees from the plane of the wall panel.

3. The modular furniture system of claim 1, further comprising a mounting rail which is attachable to a building wall, and wherein the wall panel is attached to the mounting rail to separate the wall panel from the wall.

4. The modular furniture system of claim 1, wherein the first tab comprises a projection extending from a bottom of the first tab, and wherein the projection engages the back surface of the wall panel and a portion of the first tab between the projection and the first end of the shelf bracket engages a bottom wall of the first slot.

5. The modular furniture system of claim 4, wherein the portion of the first tab between the projection and the first end of the shelf bracket is generally flat.

6. The modular furniture system of claim 1, further comprising a horizontal shelf surface which is attached to the shelf bracket and which is configured for storing an item placed thereon by a user.

7. The modular furniture system of claim 1, wherein the shelf bracket comprise an upper leg which extends towards the wall panel, a lower leg which extends towards the wall panel, and an opening formed between the upper leg and the lower leg, wherein the upper leg comprises the first tab, and wherein the lower leg comprises a first end comprising a second tab which engages a second slot in the wall panel which is located beneath the first slot.

8. The modular furniture system of claim 7, wherein the second tab comprises an outer projection which engages the back surface of the wall panel and retains the second tab in the second slot.

9. The modular furniture system of claim 8, wherein the second tab comprises an inner recess disposed between the outer projection and the first end of the lower leg, and wherein the inner recess engages a lower wall of the second slot.

10. The modular furniture system of claim 7, wherein the first end of the lower leg comprises a flat surface which engages the front face of the wall panel.

11. The modular furniture system of claim 7, wherein the lower leg is bent elastically to place the second tab into the second slot and wherein the lower leg unbends elastically after the second tab is placed into the second slot.

12. The modular furniture system of claim 11, wherein the lower leg remains elastically bent when the second tab is located in the second slot in an assembled configuration.

13. A modular furniture system comprising:

a mounting panel having a front side and a back side;

a first slot having side walls, a bottom wall, and a top wall;

wherein the top wall of the first slot comprises an upwardly sloping section which slopes upwardly away from the first slot and away from the front side of the mounting panel;

a bracket attached to the mounting panel via the first slot;

wherein the bracket has a first end attached to the mounting panel, the first end comprising a first tab which engages the first slot;

wherein the first tab comprises an upper sloped surface, the upper sloped surface sloping upwardly away from the shelf bracket at an angle which is complementary to the upwardly sloping section of the first slot;

wherein the first tab is disposed in the first slot such that the upper sloped surface of the tab engages the upwardly sloping section of the first slot and such that the first end of the bracket engages the front side of the wall panel.

14. The modular furniture system of claim 13, wherein the upwardly sloping section of the first slot is disposed at an angle which is about 30 degrees from the plane of the wall panel.

15. The modular furniture system of claim 13, wherein the first tab comprises a projection extending from a bottom of the first tab, and wherein the projection engages the back side of the mounting panel and a portion of the first tab between the projection and the first end of the bracket engages a bottom wall of the first slot.

16. The modular furniture system of claim 13, wherein the shelf bracket comprise an upper leg which extends towards the wall panel, a lower leg which extends towards the wall panel, and an opening formed between the upper leg and the lower leg, wherein the upper leg comprises the first tab, and wherein the lower leg comprises a first end comprising a second tab which engages a second slot in the wall panel which is located beneath the first slot, and wherein the lower leg is bent elastically to place the second tab into the second slot and wherein the lower leg unbends elastically after the second tab is placed into the second slot.

17. The modular furniture system of claim 16, wherein the lower leg remains elastically bent when the second tab is located in the second slot in an assembled configuration.

18. The modular furniture system of claim 16, wherein the second tab comprises an outer projection which engages the back side of the mounting panel and retains the second tab in the second slot.

19. The modular furniture system of claim 16, wherein the second tab comprises an inner recess disposed between the outer projection and the first end of the lower leg, and wherein the inner recess engages a lower wall of the second slot.

* * * * *